US006397856B1

(12) United States Patent
Lo

(10) Patent No.: US 6,397,856 B1
(45) **Date of Patent: *Jun. 4, 2002**

(54) HAIR CURLER

(76) Inventor: Zhen-Xing Lo, No. 4, Zhu-Wei Rd., Wei-Nei Village, Kan-Ding Town, Ping-Dong Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/559,582

(22) Filed: Apr. 28, 2000

(51) Int. Cl.[7] ..... A45D 1/00; A45D 1/04; A45D 2/14

(52) U.S. Cl. ..... 132/229; 132/269; 132/248

(58) Field of Search ..... 132/229, 222, 132/223, 226, 233, 220, 269

(56) References Cited

U.S. PATENT DOCUMENTS 2,631,593 A * 3/1953 Madore ..... 132/222
2,800,910 A * 7/1957 Seyffarth ..... 132/222
3,019,796 A * 2/1962 Reed ..... 132/222
3,108,603 A * 10/1963 Mobberley ..... 132/222
3,109,438 A * 11/1963 Work ..... 132/222
3,543,771 A * 12/1970 Altman ..... 132/222
3,545,457 A * 12/1970 Schepis ..... 132/222
3,960,156 A * 6/1976 Thompson ..... 132/222
4,136,705 A * 1/1979 Kulpa ..... 132/226
5,535,764 A * 7/1996 Abramson ..... 132/200
5,538,021 A * 7/1996 Kim ..... 132/222
6,041,791 A * 3/2000 Belmonte et al. ..... 132/222
6,114,661 A * 9/2000 Leung ..... 219/222
6,186,150 B1 * 2/2001 Lo ..... 132/269

* cited by examiner

*Primary Examiner*—John J. Wilson
*Assistant Examiner*—Robyn Kieu Doan
(74) *Attorney, Agent, or Firm*—Troxell Law Office PLLC

(57) ABSTRACT

A hair curler includes a first curling member and a second curling member both shaped rectangular and having respectively an adhering means fixed on an outer surface, a lead wire attached to the first or the second curling member, and heaters located at one side of the lead wire and connected to the lead wire.

9 Claims, 2 Drawing Sheets

HAIR CURLER

BACKGROUND OF THE INVENTION

This invention relates to a hair curler, particularly to one easy to handle and increasing curling effect as well as protecting hair quality.

A conventional hot hair curling method is carried out by hairdressers using hair cutlers to wind hair on them and also using medicine to produce heat to perform hair curling process. As for a cool curling method, a hairdresser winds hair around a hair curler and then envelope the hair with medicine and then wets hair with a curling lotion and warmed up for a preset period of time, and then wash off the curling lotion, and pours a second round of curling lotion in the hair and warm up for another period of time to finish after the hair is confirmed to be surely curled. Then the hair curlers are removed from the hair, always taking at least two hours for cool hair curling. Hot hair curling may take less time, nearly two hours.

Regardless of cool curling or hot curling process, curling appliances have not been designed to have really practical effect, and especially a supplying way of heat energy has not yet improved, leading to some harm to hair quality whenever hair is treated with hot curling process.

In general, the conventional cool or hot curling method or appliances have been found to have disadvantages that operation is slow, curling quality is not good, or hair is hurt.

SUMMARY OF THE INVENTION

The objective of the invention is to offer a hair curler easily to operate, increasing curling effect and protecting hair quality.

The feature of the invention is a first curling member of a rectangular shape and having an attach component around its outer surface, and a second curling member of a rectangular shape and having an attach component around its outer surface. The first and the second curling member are attached with each other to clamp hair between them. Lead wires are connected to the first or the second curling member and a heater is placed at a side of the lead wires.

BRIEF DESCRIPTION OF THE INVENTION

A preferred embodiment of a hair curler in the present invention, as shown in

Figure 1:
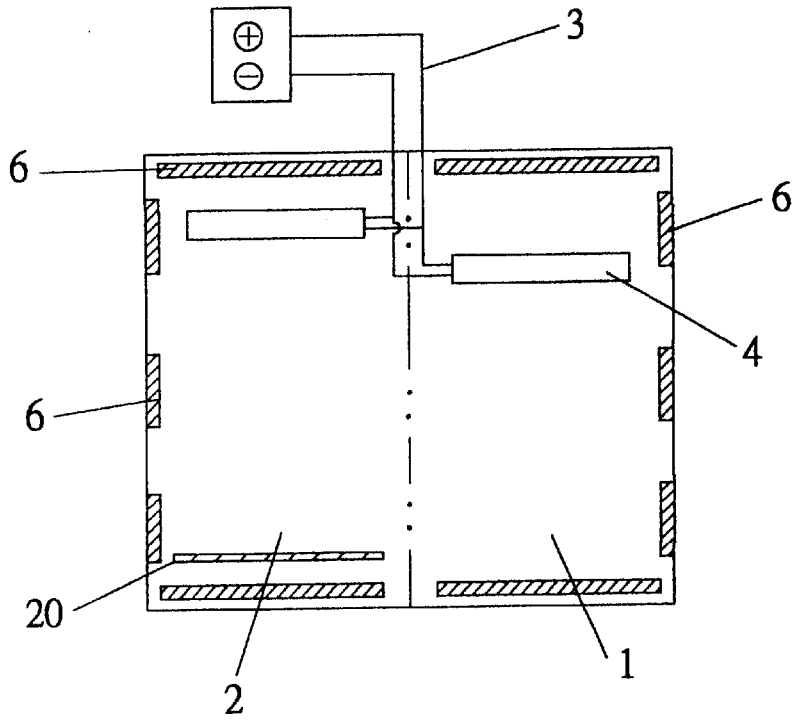
Figure 2:
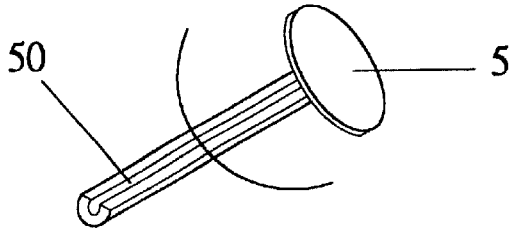
Figure 3:
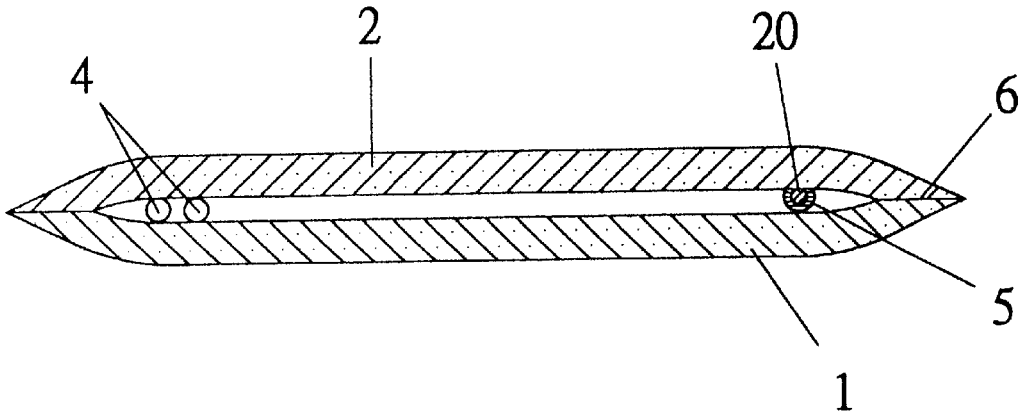
Figure 4:
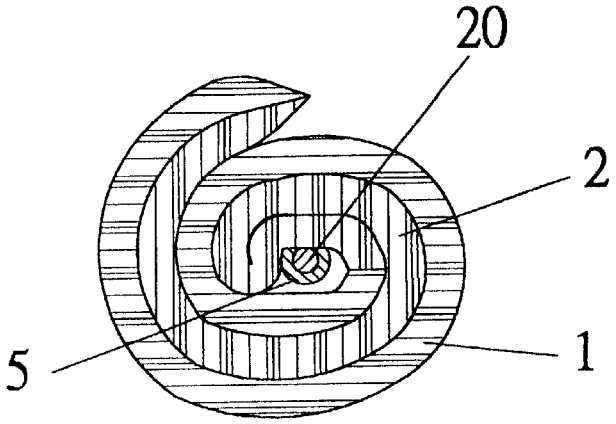

FIGS. 1, 2, 3 and 4, includes a first curling member 1, a second curling member 2, a lead wire 3, a heater 4, and a rotatable bar 5 as main components.

The first curling member 1 has a rectangular shape, made of a plastic, high-temperature enduring, acid and alkali resistant plastic plate or soft steel plate so as to attach with other components or to wind up together. An insulating material envelops the outer surface of the first curling member so as not to electrify a person receiving curling process to protect the person. At the same time adhering means 6 such as Velcro bands or the like are attached on a proper location of the outer surface. Then when the first and the second curling members 1 and 2 are attached together, they are tightly kept together, not so easily separating from each other.

The second curling member 2 also has a rectangular shape, to be attached with the first curling member 2 with hair clamped between them, made of the same material as the first curling member, flexible to be attached with another component and wound up together. Further, an insulating material is also enveloped around the outer surface of the second curling member 2, protecting a person receiving curling process from electrified when the hair curler is powered. Adhering means 6 such as a Velcro band is also attached on a proper location of the outer surface of the second curling member 2 attaching with that of the first curling member 1 not easily falling off. In addition, a pin 20 is provided on an end of the second curling member 2 to insert in another component to rotate or wind the second curling member 2.

The lead wire 3 is connected to the first curling member 1 or the second curling member 2, transmitting electricity from an exterior power to electrify a related component to covert electricity into another energy. A heater 4 is located at one side of and connected to the lead wire 3, powered to produce heat, and preferably a PTC (positive temperature coefficient) ceramic heater.

Further, the second curling member 2 has one end pivotally connected to a rotatable bar 5, which may wind up the second curling member 2 and the first curling member 1 together after the both 1 and 2 are attached together by means of the adhering means 6. The rotatable bar 5 is shaped as a hollow column, having a lengthwise groove 50 on an outer surface, and the pin 20 of the second curling member 2 may insert in the hollow through the groove 50 of the rotatable bar 5. So if the rotatable bar 5 is rotated, the first curling member 1 and the second curling member 2 are wound together because of the rotatable bar 5 is completely positioned in the second curling member 2.

The hair curler in the invention has different using ways in operation according to demands. For example, if it is to be used for making cool flat hair style, hair adhered with warming hair lotion is positioned on the first curling member 1, and then the second curling member 2 is attached with the first curling member to perform making cool flat hair style.

Next, if it is used for making cool curling hair style, hair adhered with warming hair lotion is positioned on the first curling member 1, and then the second curling member 2 is attached with the first curling member 1, with the pin 20 directly inserted in the hollow of the rotatable bar 5. Then rotating the rotatable bar 5 will wound up both the first and the second curling member 2 together in different degree of curvature.

Moreover, if it is used for making hot flat hair style, as shown above, hair adhered with warming hair lotion is positioned in the first curling member 1, and then the ceramic heater 4 is respectively placed on one end of the first and the second curling member 1 and 2. After that, the second curling member 2 is attached with the first curling member 1, and powering the ceramic heaters 4 will produce far infrared ray to warm up the hair, at the same time protecting and nourishing hair by means of the for infrared ray.

Likewise, if it is used for making hot curling hair style, in the same way as described just above, hair adhered with warming hair lotion is positioned in a first curling member 1, and then the ceramic heater 4 is respectively placed on one end of the first and the second curling member 1 and 2. Then rotating the rotatable bar 5 will wind up the firs and the second curling member 1 and 2 together, and in different degree of curvature wanted. Then the finished curvature surpasses that got by the common curling way, and besides that, the far infrared ray produced by the ceramic heater 4 have enough function of protecting and nourishing hair.

The invention has the following advantages, as can be understood from the aforesaid description.

1. The hair curler consists of the first and the second curling member attached with each other to make flat hair style, or making us of the rotatable bar to wind up the first and the second curling member together may make curling hair style, and to a curvature wanted. In addition, its operation is quick, convenient, and incomparable with common hair curlers,
2. The hair curler can perform various hair styles, including a cool flat hair style, a cool curled hair style, by attaching the first and the second curling member and with the rotatable bar winding up the first and the second curling member together, as the both are made of flexible material such as plastic plates or soft steel plates. Then hot flat or curled hairstyle may be performed as well, by adding the ceramic heaters to produce heat energy needed.
3. The hair curler can protect hair by using flat plates or wound up plates in addition to the ceramic heaters 4 for producing far infrared ray, which has the property of hair protecting and nourishing function, not harming hair quality a bit, and keeping longer the hair curvature than done by the common furling methods.

While the preferred embodiment of the invention has been described above, it will be recognized and understood that various modifications may be made therein and the appended claims are intended to cover all such modifications that may fall within the spirit and scope of the invention.

I claim:

1. A hair curler comprising:

a first rectangular curling member having a first adhering means fixed on an outer surface;

a second rectangular curling member having a second adhering means fixed on an outer surface to attach with said first curling member to clamp hair between them;

a lead wire attached with one of said first curling member and said second curling member: and, heaters located at a side of said lead wire and connected to said lead wire.

2. The hair curler as claimed in claim 1, wherein said first and said second curling members are made of a high-temperature-enduring, acid and alkali resistant material.

3. The hair curler as claimed in claim 1, wherein said first and said second curling members each have a layer of insulating material enveloped on the respective outer surfaces.

4. The hair curler as claimed in claim 1, wherein said first and second adhering means on the outer surfaces of said first and said second curling member comprise hook and loop fastening bands.

5. The hair curler as claimed in claim 1, wherein said first and second adhering means on the outer surfaces of said first and said second curling member comprise an adhesive material.

6. The hair curler as claimed in claim 1, wherein said heater is a ceramic heater.

7. The hair curler as claimed in claim 1, wherein said second curling member has one end fixed with a pin to facilitate said second curling member being wound.

8. The hair curler as claimed in claim 1, wherein said first and said second curling members have one end pivotally connected to a rotatable bar, wherein said rotatable bar winds said first and said second curling members together after said first and said second curling members are attached with each other.

9. The hair curler as claimed in claim 8, wherein said rotatable bar comprises a hollow column, having a lengthwise groove formed in an outer surface.

* * * * *